US005433037A

United States Patent [19]

Pazio

[11] Patent Number: 5,433,037

[45] Date of Patent: Jul. 18, 1995

[54] GATE CLOSING APPARATUS WITH MANUAL RELEASE

[75] Inventor: Jan Pazio, Sun Valley, Calif.

[73] Assignee: Court Security Systems, Inc., Valencia, Calif.

[21] Appl. No.: 98,718

[22] Filed: Jul. 29, 1993

[51] Int. Cl.[6] ..... E05F 15/00

[52] U.S. Cl. ..... 49/139; 49/340

[58] Field of Search ..... 49/139, 140, 141, 339, 49/340, 345

[56] References Cited

U.S. PATENT DOCUMENTS

| | | | |
|---|---|---|---|
| 3,500,585 | 3/1970 | Vollmar | 49/340 X |
| 4,337,670 | 7/1982 | Carlson | 49/139 X |
| 4,403,449 | 9/1983 | Richmond | 49/139 X |
| 4,429,264 | 1/1984 | Richmond | 49/139 X |
| 4,934,203 | 6/1990 | Bailey et al. | 49/340 X |
| 4,970,826 | 11/1990 | Richmond et al. | 49/141 X |

*Primary Examiner*—Jerry Redman
*Attorney, Agent, or Firm*—Jack C. Munro

[57] ABSTRACT

A gate opening apparatus which utilizes a horizontably swingable arm assembly which is to be operated electrically to effect movement of a gate between a closed position and an open position. The arm assembly is mounted through a latching mechanism to the motor mechanism of the gate opening apparatus. This latching mechanism can be manually released which will permit the arm assembly to pivot through a vertical plane so as to provide for manual movement of the gate between the open and closed position during instances when electrical power is not available to operate the gate opening apparatus.

8 Claims, 5 Drawing Sheets

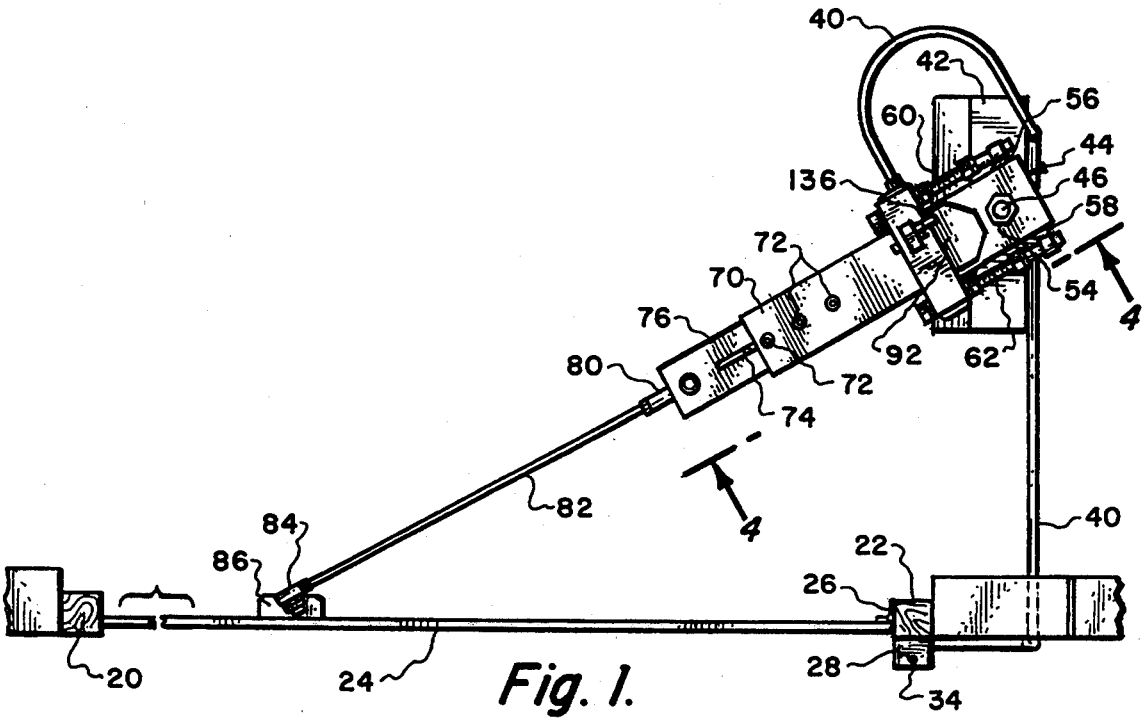
Fig. 1.
Fig. 3.
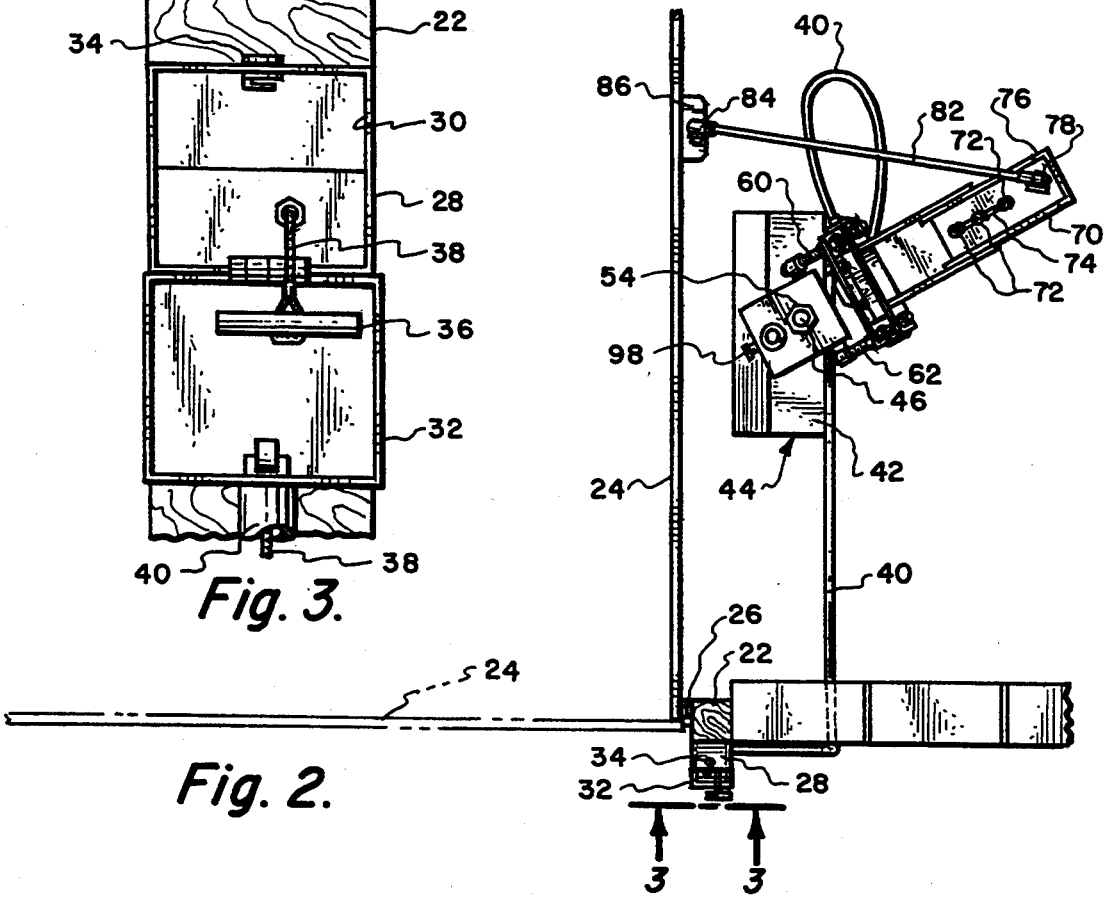
Fig. 2.

GATE CLOSING APPARATUS WITH MANUAL RELEASE

BACKGROUND OF THE INVENTION

1) Field of the Invention

The field of this invention relates to an electrically operated gate opening apparatus and more particularly to a manual release mechanism associated with the gate opening apparatus which will permit the apparatus to be manually operated in an easy manner when electrical power is not available to operate the apparatus.

2) Description of the Prior Art

Gates located across streets, driveways and pathways are in exceedingly common usage. The purpose of the gate is to permit access only by authorized individuals. Most gates are electrically operated. However, in the case of a power failure, there is a need to permit manual operation of the gate.

It is exceedingly common that a gate will weigh several hundred pounds. Manual movement of the gate in conjunction with an electrically operated gate opening and closing apparatus can require a substantial amount of manual force, especially if the gate opening and closing apparatus produces a significant amount of resistance to the manual operation. This manual operation must inactivate the gate opening and closing apparatus so that it supplies very little resistance to the manual operation of the gate. At the same time the release mechanism must provide security so that it can be activated only by an authorized individual. The release of the gate apparatus so as to permit the manual operation of the gate must be easily accomplished from both outside the gate and inside the gate. Release outside the gate is necessary as by the Fire Department in an emergency situation in order to gain access through the entrance which is normally closed by the gate.

SUMMARY OF THE INVENTION

The structure of the present invention is directed to a gate opening and closing apparatus which includes a release mechanism which when activated produces only a small amount of resistance to manual operation of the gate. The apparatus includes an elongated arm that is connected to the gate. Normal operation of the apparatus causes the arm to pivot within a horizontal plane with this normal operation occurring by operation of an electrical motor. Activation of the release mechanism associated with the apparatus of the present invention permits the arm to move within a vertical plane with this movement of the arm completely eliminating trying to manually move the arm against the resistance of the electrical motor and its associated gearing. Therefore, during manual operation of the apparatus, the apparatus exhibits a minimal amount of resistance to the manual opening and closing of the gate. Manual disengagement of the release mechanism can be accomplished remotely exteriorly of the gate. Manual operation can also be accomplished directly on the apparatus itself by an individual located interiorly of the gate.

One of the primary objectives of the present invention is to construct a manual release mechanism in conjunction with a gate opening and closing apparatus which will free the gate so that it can be easily manually opened and closed.

Another objective of the present invention is to construct a release mechanism utilized in conjunction with a gate opening and closing apparatus which is simple in construction and therefore can be manufactured at a minimal cost in conjunction with a gate opening and closing apparatus to be sold to the consumer at a reasonable cost.

BRIEF DESCRIPTION OF THE DRAWINGS

FIG. 1 is a top, plan view of a typical gate to which is connected a gate opening and closing apparatus within which has been incorporated the manual release mechanism of the present invention showing the gate in the closed position;

FIG. 2 is a view similar to FIG. 1, but showing the gate in the open position;

FIG. 3 is a front view of a remotely located box within which is located a lever to actuate the manual release of the gate opening and closing apparatus which is taken along line 3—3 of FIG. 2;

DETAILED DESCRIPTION OF THE SHOWN EMBODIMENT

Figures 4, 5:
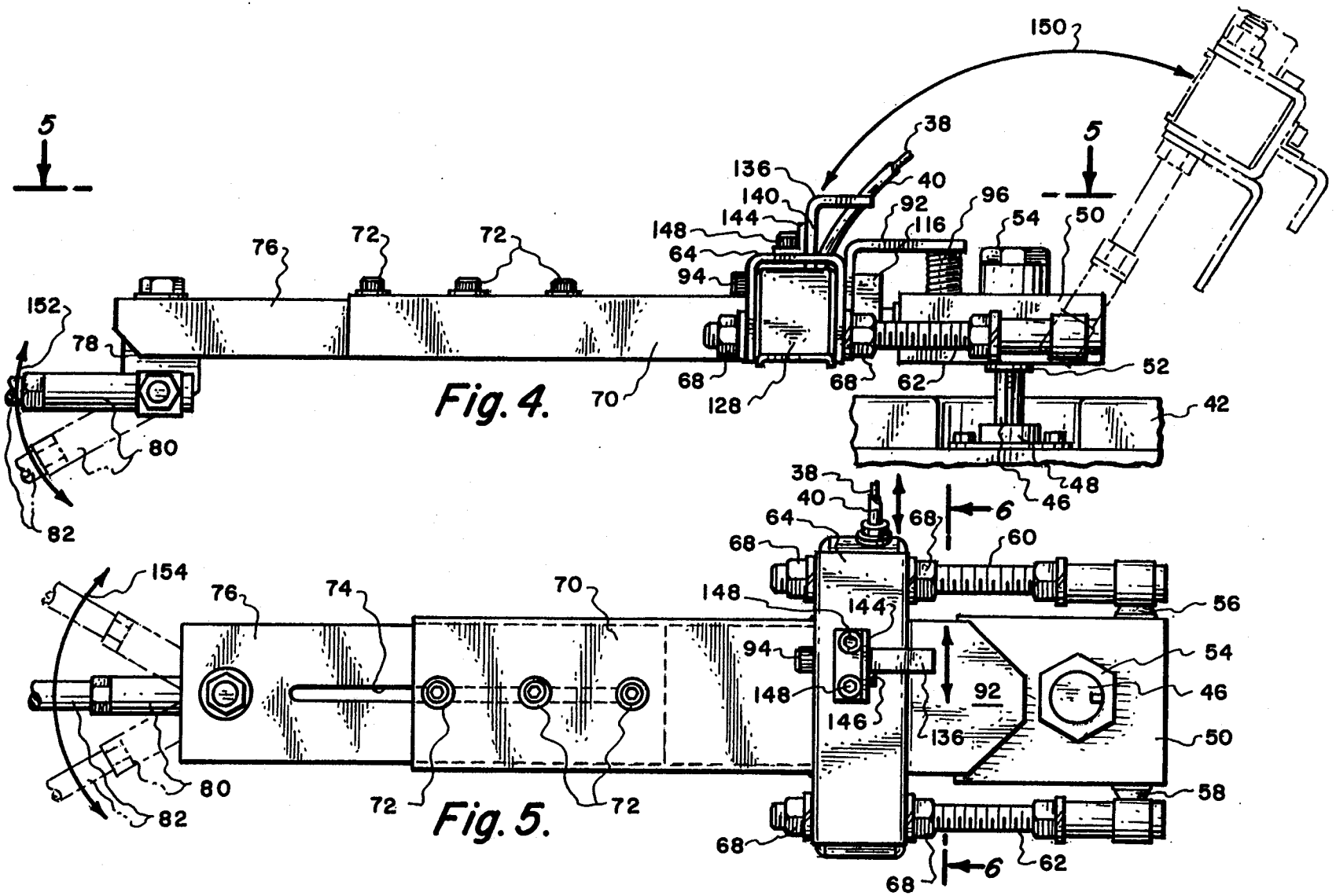
FIG. 4 is a side elevational view of the gate opening and closing apparatus of the present invention taken along line 4—4 of FIG. 1.
FIG. 5 is a top, plan view of the arm assembly utilized in conjunction with the gate opening and closing apparatus of the present invention taken along line 5—5 of FIG. 4.

Referring particularly to the drawings, there is shown a pair of spaced apart gate posts 20 and 22 which will normally be embedded within ground (not shown). There is a space located between the gate posts 20 and 22 and within the confines of that space is located a gate 24. The gate 24 will normally be constructed of wrought iron or other similar type of material with it being understood that the material of construction for the gate 24 can be any desired material. The gate 24 is mounted by a hinge 26 on the post 22. The gate 24 is to be pivotaly movable between the closed position shown in FIG. 1, closing the space between the posts 20 and 22, to an open position depicted in solid lines in FIG. 2. With the gate 24 in the open position, access through the gate 24 will be permitted.

Mounted exteriorly of the gate 24, such as on the exterior surface of the post 22, there is a box 28. The box 28 has an internal compartment 30. Connected to the box 28 is a lid 32. The lid 32 can be moved from the open position shown in FIG. 3 to a closed position closing the internal chamber 30 to the ambient. With the lid 32 in the closed position, there is a lock 34 which is to be operated to maintain the lid 32 closed relative to the box 28. The lock 34 can comprise a key-operated lock or could be a combination-type lock, or any other desirable form of lock. The lock 34 is to be operable by an authorized individual, generally the owner of the premises that is protected by the gate 24 and possibly also a fire department or other emergency type of individuals.

Once access to the internal chamber 30 is obtained, there is exposed a handle 36. Handle 36 is connected to the outer end of a cable 38. Cable 38 passes through a conduit 40 which connects to the box 28. Conduit 40 connects to a housing 42 of a gate opening and closing apparatus 44. Within the housing 42 is located a motor (not shown) which is to be electrically operated by a source of electricity to cause rotation of motor output shaft 46. Motor output shaft 46 is mounted by a bearing mount 48 onto the housing 42.

Fixedly secured onto the output shaft 46 is a bushing 52. Fixedly secured onto the output shaft 46 and supported against the bushing 46 is a mounting plate 50. A nut 54 is fixed onto the upper free end of the output shaft 46 and abuts against the mounting plate 50. Fixedly secured to one side of the mounting plate 50 is a pivot rod 56 with a similar such pivot rod 58 being fixedly mounted on the opposite side of the mounting plate 50. The pivot rods 56 and 58 are located in an axially aligned position.

A threaded rod 60 is pivotally mounted on pivot rod 56 with a similar threaded rod 62 being pivotally mounted on the pivot rod 58. The outer end of threaded rod 60 is fixedly mounted onto a U-shaped attaching plate 64. The outer end of the threaded rod 62 is also fixedly mounted to the U-shaped attaching plate 64. The U-shaped attaching plate 64 has an internal compartment 66 formed by the spacing between the legs of the U-shaped attaching plate 64. Threaded rods 60 and 62 extend across each of the legs of the attaching plate 64. The threaded rods 60 and 62 are secured to the attaching plate 64 at the particular desired location by means of nuts 68. The use of the nuts 68 and the threaded rods 60 and 62 provide for adjusting of the position of the attaching plate 64 relative to the mounting plate 50. A rather precise position of the attaching plate 64 will be preferred relative to the mounting plate 50 so that there is a certain amount of clearance so that freedom of movement of the attaching plate 64 will be permitted relative to the mounting plate 50.

Welded onto the attaching plate 64 and extending outwardly therefrom is a channel-shaped inner arm member 70 of an arm assembly. This inner arm member 70 has a plurality of holes each of which is to engage with a bolt and nut fastener 72. These bolt and nut fasteners 72 ride within a slot 74 which is formed within outer arm member 76 of the arm assembly. Pivotally mounted to the outer end of the outer arm member 76 is a bracket 78. Pivotally secured to the bracket 78 is a mounting sleeve 80. A rod 82 is to be threadably fixedly secured to the mounting sleeve 80. The outer end of the rod 82 is fixed to a sleeve 84 which is pivotally mounted to a mounting bracket 86. The mounting bracket 86 is fixed onto the gate 24.

The top wall of the mounting plate 50 has a bolt 88 conducted therethrough. Nuts 90 are used to secure in position the bolt 88 to the mounting plate 50. The length of the bolt 88 is selected so that the outer end of the bolt 88 will function as movement limiting device when such contacts L-shaped bracket 92. L-shaped bracket 92 is fixedly mounted by bolt and nut fasteners 94 to the attaching plate 64. With the L-shaped plate 92 in contact with the outer end of the bolt 88, the arm assembly composed of arm members 70 and 76 is located in what is defined as the horizontal position. This will be the position for the arm assembly during normal electrical operation causing opening and closing movement of the gate 24 with the arm assembly, composed of arms 70 and 76, swinging in a horizontal plane caused by rotation of the output shaft 46. This type of horizontal swinging motion is well known and is commonly used in conjunction with gate opening and closing apparatuses. However, in case of a power failure, it is desirable to have the gate 24 to be opened manually and it is this structure that constitutes the primary inventiveness of the present invention and will now be described in detail.

Figure 11:
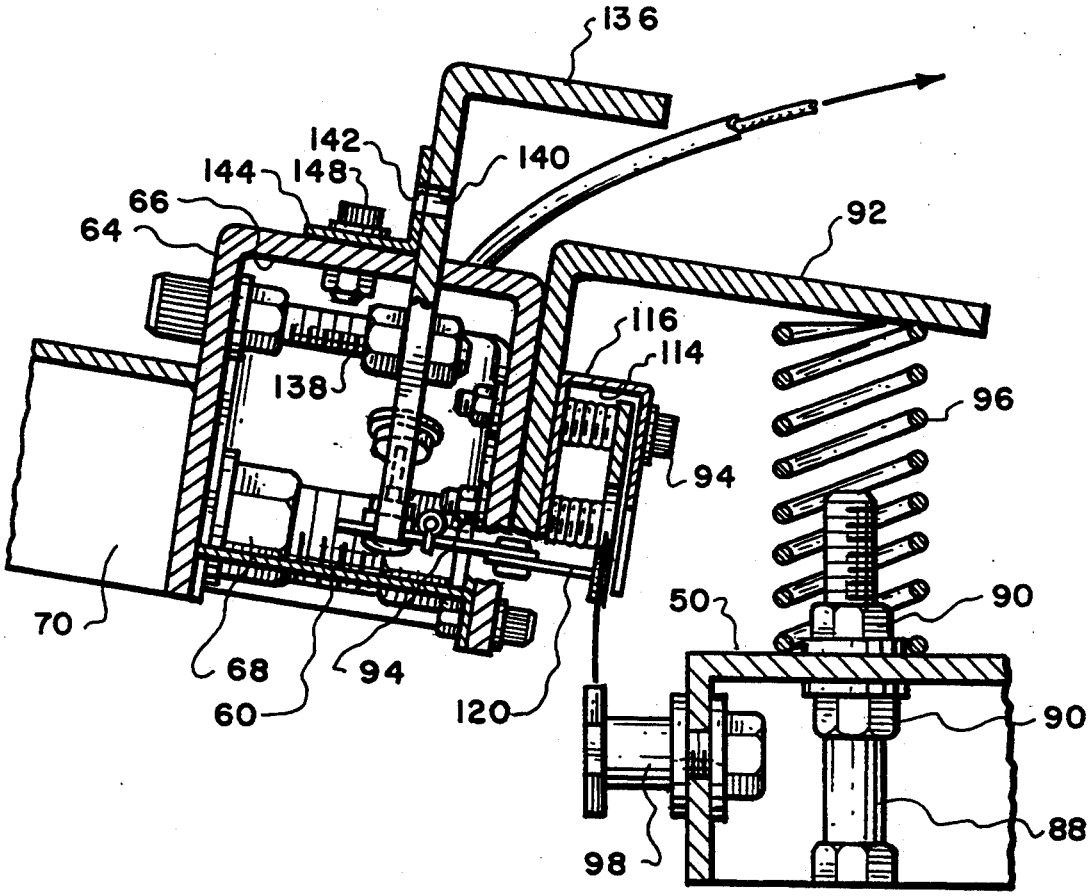
FIG. 11 is a view similar to FIG. 8 but showing the arm assembly in the initial inclined position caused by the bias of a coil spring with the latching mechanism in the unlatched position.

Located about the bolt 88 is a coil spring 96. One end of this coil spring 96 is to rest against the upper surface of the mounting plate 50 with the opposite end of the coil spring 96 resting against the undersurface of the L-shaped bracket 92. The force of this coil spring 96 will normally exert a sufficient bias against the bracket 92 so as to locate the arm assembly, composed of arm members 70 and 76 in a slightly inclined position as is shown in FIG. 11 of the drawings. This means that the arm assembly composed of arms 70 and 76 will be pivoted slightly, this pivoting action occurring between threaded rod 60 and pivot rod 56, and threaded rod 62 and pivot rod 58. This inclined position is within a vertical plane which is perpendicular to the previously described horizontal plane through which the arm assembly composed of arm members 70 and 76 is moved during normal operation of the gate 24. The purpose of establishing the arm assembly in this inclined position is important so as to permit manual operation of the gate 24 as will become apparent further on in the description.

Fixedly mounted on the front wall of the mounting plate 50 is a latching pin 98. With the arm assembly composed of arm members 70 and 76 located in the horizontal position, the coil spring 96 will be compressed and L-shaped plate 92 will essentially abut against (or be located very near) the outer end of the bolt 88, at which time a pair of latching pawls 100 and 102 latchingly engage with the latching pin 98, holding the arm assembly in the established or horizontal position. Latching pawl 100 is pivotally mounted on a pivot pin 104 with latching pawl 102 being pivotally mounted on a pivot pin 106. Pivot pins 104 and 106 are actually a pair of the fasteners 94.

Figure 7:
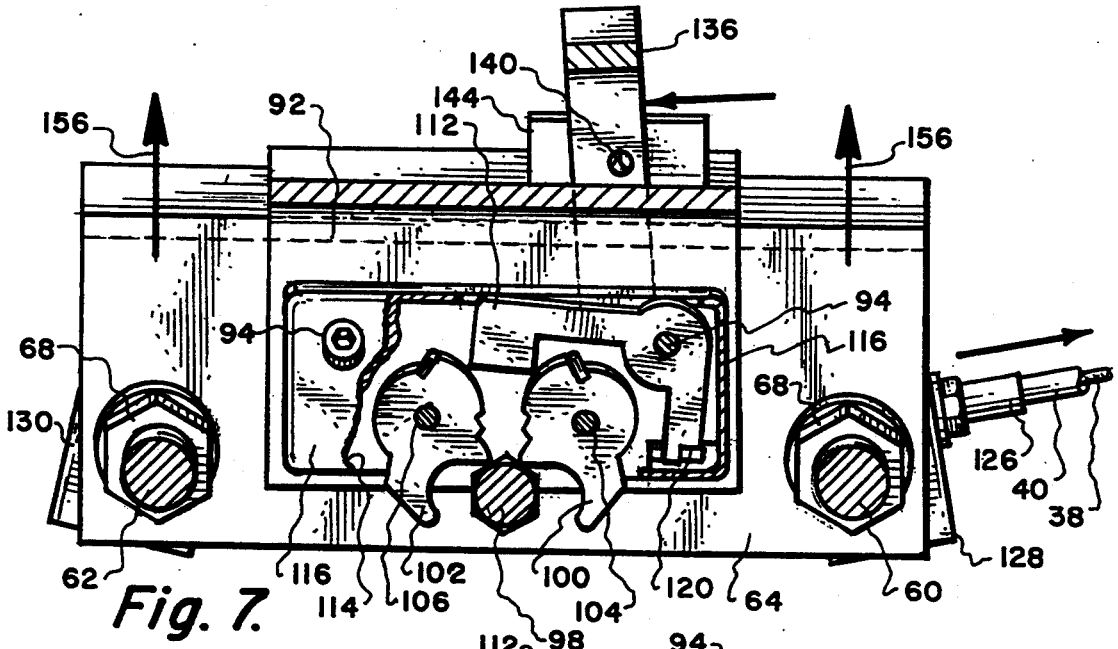
FIG. 7 is a view similar to FIG. 6 but showing the latching mechanism in the unlatched position.

Surrounding the pivot pin 104 is a spring 108. A similar spring 110 surrounds the pin 106. Spring 108 exerts a continuous bias on the pawl 100 and spring 110 exerts a continuous bias on the pawl 102 tending to locate both in the unlatched position shown in FIG. 7 of the drawings. When in the unlatched position for the pawls 100 and 102, a latching lever 112 is located also in an unlatched position as is shown in FIG. 7. This lever 112, as well as pawls 100 and 102, are contained within interior chamber 114 of a latch housing 116. This latch housing 116 is fixedly positioned onto the L-shaped mounting plate 92 by means of the fasteners 94.

Figure 6:
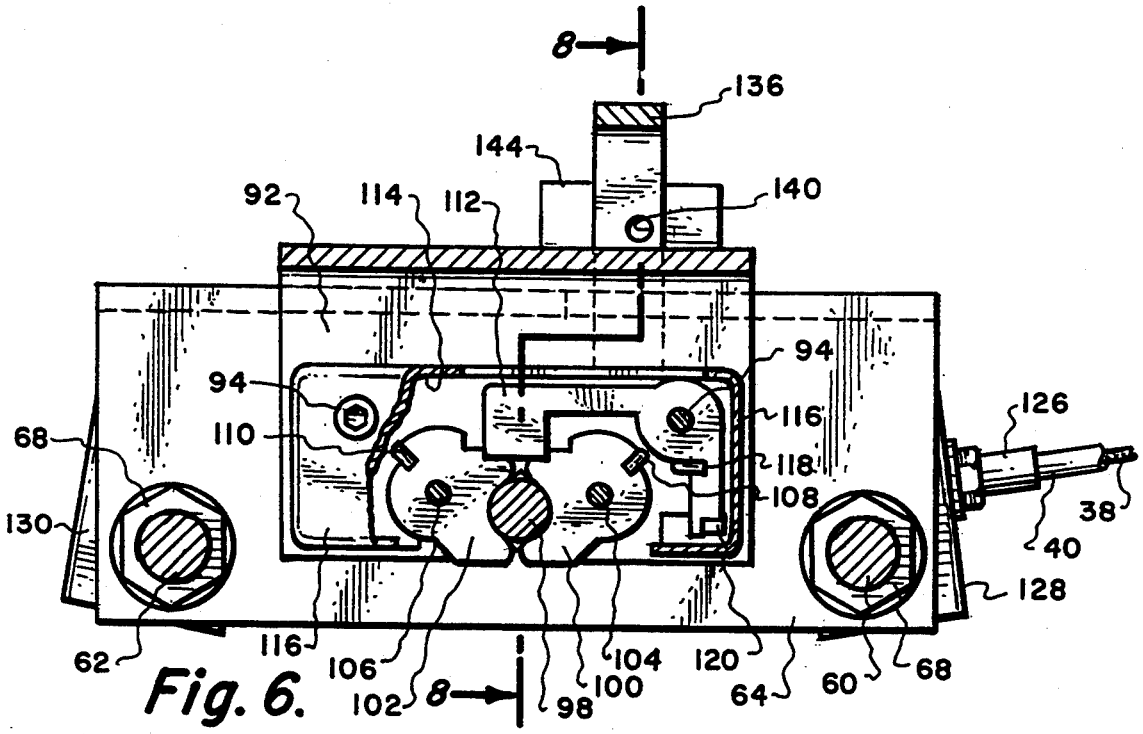
FIG. 6 is a view, partly in cross section, through the gate opening and closing apparatus of the present invention taken along line 6—6 of FIG. 5 showing the latching mechanism between the arm assembly and the motor mechanism and showing the latching mechanism in the latched position.
Figure 10:
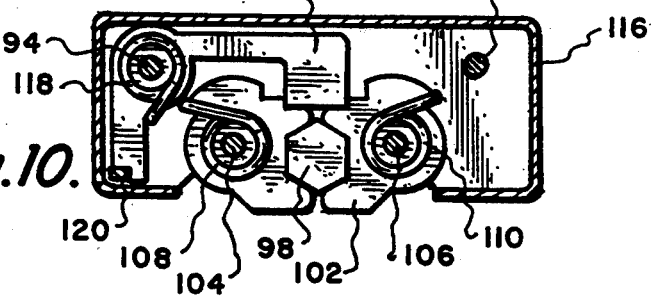
FIG. 10 is a cross sectional view of the latching mechanism taken in a direction opposite that of FIG. 6 taken along line 10—10 of FIG. 9.
Figure 8:
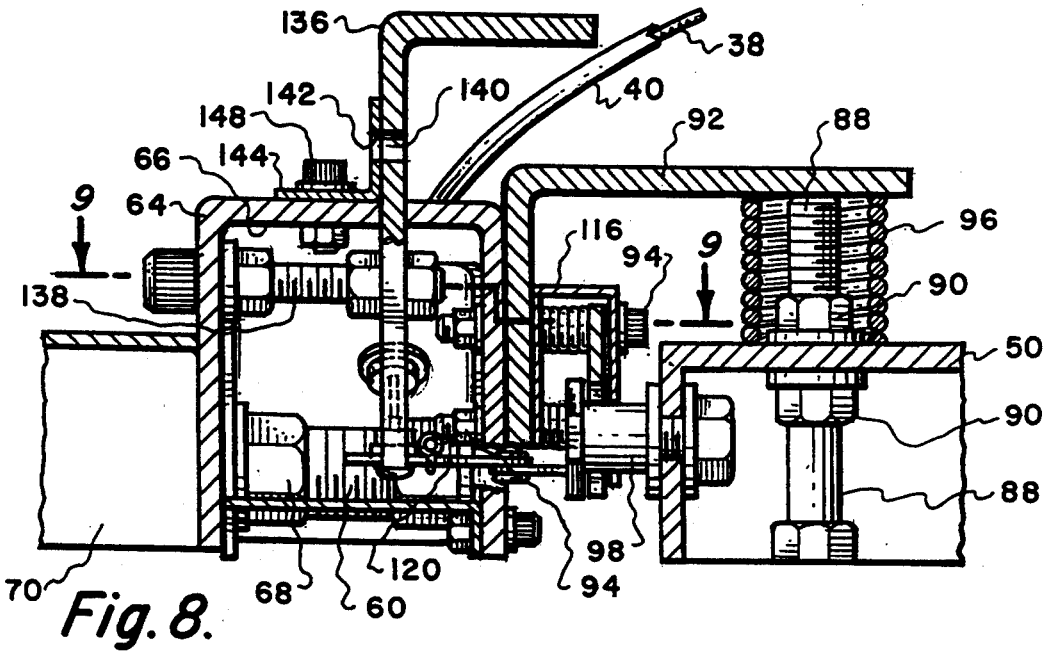
FIG. 8 is a cross sectional view showing in more detail the latching mechanism included within the gate opening and closing apparatus of the present invention taken along line 8—8 of FIG. 6.

The latching lever 112 is pivotally mounted onto one of the fasteners 94 and surrounding that fastener 94 and located within the confines of the interior chamber 114 and connecting with the lever 112 is a coil spring 118. The coil spring 118 exerts a continuous bias on the lever 112, tending to force it toward the engaged position which is clearly shown in FIGS. 6 and 10 of the drawings. In the engaged position the lever 112 rides within appropriate grooves formed within the locking pawls 100 and 102 holding the pawls 100 and 102 in the latched position. However, the latching lever 112 connects with an actuating lever 120. The actuating lever 120 is pivotaly mounted by a pivot pin 122 to the L-shaped bracket 92. The outer end of the actuating lever 120 is pivotally connected to a connector 124. The cable 38 passes through guiding connector 126 which is fixedly mounted on side plate 128 with the cable 38 then connecting with the connector 124. A plate 128 is pivotally mounted on the threaded bolt 62. A similar side plate 130 is pivotally mounted on the threaded bolt 60. Both side plates 128 and 130 are located within the internal compartment 66.

Figure 9:
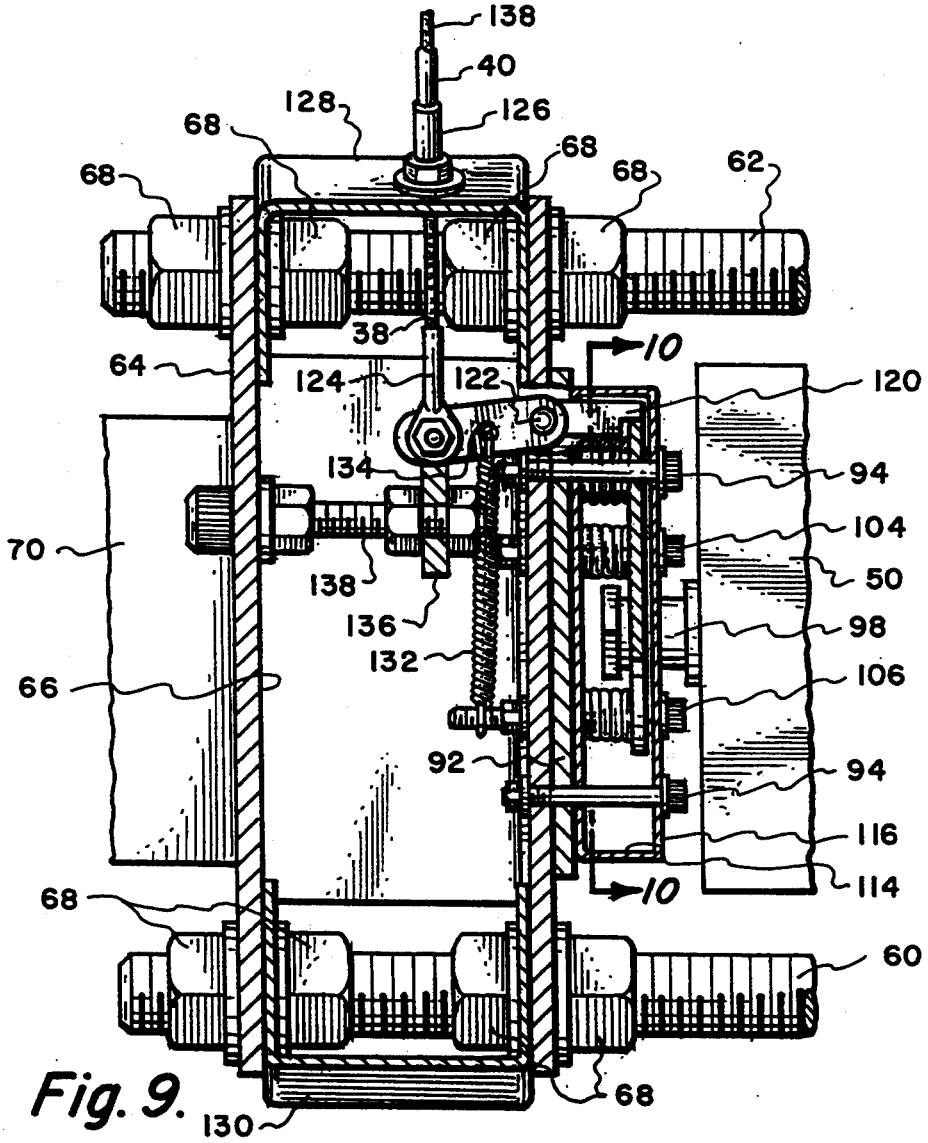
FIG. 9 is a cross sectional view taken along line 9—9 of FIG. 8.

One end of the coil spring 132 is mounted within hole 134 formed within the actuating lever 120. The opposite end of the coil spring 132 is fixed to one of the fasteners 94 which happens to be fastener 106. The coil spring 132 exerts a continuous bias on the actuating lever 120 tending to locate such in the unlatched position shown in FIG. 9 of the drawings. However, when cable 38 is pulled, with this pulling action occurring by means of manually pulling on handle 36, the actuating lever 120 pivots about the pivot pin 122. This pivoting of the actuating lever 120 moves latching lever 112 against the bias of its spring 118 and moves the latching lever 112 to the unlatched position. This will permit the latching pawls 100 and 102 to pivot due to the continuous bias being applied by their respective springs 108 and 110 to the unlatched position shown in FIG. 7. This will permit the arm assembly composed of arm members 70 and 76 to pivot to the inclined position shown in FIG. 11.

As manual force is applied on the gate 24, tending to move the gate 24 to the open position which is shown in FIG. 2 of the drawings, the arm assembly composed of arm members 70 and 76 will be pivoted further within the vertical plane with L-shaped bracket 92 becoming spaced from the spring 96 and the vertical plane pivoting being permitted by threaded rods 60 and 62 pivoting on their respective pivot rods 56 and 58. This pivoting will occur for about 120 to 140 degrees substantially to the position shown in FIG. 2, at which time the gate 24 assumes a perpendicular position relative to the closed position of the gate 24 shown in FIG. 1. During this pivoting movement, the rod 82 pivots relative to the mounting bracket 86 and also relative to the outer arm member 76 to the position shown in FIG. 2.

It is to be understood that gate 24 must be moved manually back to the closed position before the gate 24 can be operated electrically in the normal manner. It is to be noted that during the manual movement of the gate 24, at no time is it necessary to turn the arm assembly composed of arms 70 and 76 against the resistance of the motor through the motor output shaft 46. In other words the manual operation of opening and closing of the gate 24 completely by-passes the resistance of the motor, thereby making it inherently much easier to manually open and close the gate 24.

There is also included a release mechanism directly on the attaching plate 64 in the form of a release lever 136. This release lever is to be manually movable in lieu of pulling on the handle 36. The handle 36 is to be pulled by an individual on the outside of the gate 24. On the inside of the gate 24, the individual only needs to proceed directly to the apparatus 44 and move the release lever 136 which pivots about fastener 138 which is fixedly mounted on the U-shaped attaching plate 64. The lower end of the release lever 136 is to abut up against the actuating lever 120. Movement of the release lever 136 will duplicate the previous movement described by the cable 38 in causing pivoting of the actuating lever 120 which in turn will release the latching lever 112. This release lever 136 rides within an appropriate slot 146 formed within the U-shaped attaching plate 64. There is a hole 140 formed within the release lever 136 which is to align with a hole 142 formed within a securing bracket 144. This securing bracket 144 is fixedly mounted onto the U-shaped attaching plate 64 by means of a pair of bolt and nut fasteners 148. A padlock type of locking arrangement can be used to connect with the aligned holes 140 and 142 to prevent manual movement of the release lever 136, if such is deemed to be desired. This would prevent some unauthorized individual from operating the release lever 136. In the same manner, box 30 and lid 32 is to be locked by lock 34 in order to prevent operation of the handle 36. It is to be understood that an unauthorized individual could operate the handle 36 a release lever 136, if it was available, and move the gate 24 from the closed position to the open position. Using the locking devices previously described, manual operation of the gate 24 is prevented.

When manual operation of the gate is desired, it is necessary to get the "movement started" so the manual force will cause the arm assembly composed of arm members 70 and 76 to be pivoted to the positions shown in FIG. 2. It is for this reason, that upon release of the latching pawls 100 and 102, the spring 96 will immediately force the arm assembly to an "over center" inclined position so that as manual force is applied to the arm assembly that this manual force will continue to move the arm assembly in a further upward position within the vertical plane.

Referring particularly to FIG. 4, arrow 150 depicts the limits of this vertical plane movement. Also in FIG. 4, the arrow 152 depicts some of the pivoting motion of the sleeve 80 with the remaining portion of the pivoting motion being shown by arrow 154 in FIG. 5. Once the latching pawls 100 and 102 are released, the upward movement of the U-shaped attaching plate 64 is shown by arrow 156 in FIG. 7.

What is claimed is:

1. In combination with a gate opening apparatus having an electrically operated motor mechanism, an arm assembly having an inner end connected to said motor mechanism and an outer end adapted to be connected to a gate, said arm assembly being pivotably movable by said motor mechanism within a horizontal plane between a first position and a second position, said first position defining a gate open position and said second position defining a gate closed position, a manual release mechanism, said manual release mechanism comprising:

a latching means connected between said motor mechanism and said arm assembly, said latching means being locatable in an unlatched position and a latched position, said latched position confining the movement of said arm assembly to said horizontal plane, said unlatched position permitting movement of said arm assembly within a vertical plane substantially perpendicular to said horizontal plane between an inner position and an outer position, said inner position being located directly adjacent said horizontal plane, said outer position being at least ninety degrees spaced from said inner position.

2. The combination as defined in claim 1 wherein:
said motor mechanism having an output shaft, a mounting plate being fixedly mounted on said output shaft, said inner end of said arm assembly being pivotally mounted on said mounting plate.

3. The combination as defined in claim 2 wherein:
spring means located between said arm assembly and said mounting plate, said spring means functioning to exert a continuous bias on said arm assembly when in said inner position tending to move said arm assembly toward said outer position.

4. The combination as defined in claim 3 wherein:
with said latching means in said unlatched position said spring means locating said arm assembly in an inclined position permitting manual movement of said arm assembly to said unlatched position.

5. The combination as defined in claim 1 wherein:
said latching means being movable between said latched position and said unlatched position by a remote operation means, said remote operation means being located in a location spaced from said arm assembly and said motor mechanism.

6. The combination as defined in claim 1 wherein:
said manual release mechanism including a release lever, said release lever being mounted on said arm assembly, said release lever being manually movable directly on said arm assembly and manually movable by a remote operation means.

7. The combination as defined in claim 1 wherein:
said arm assembly being longitudinally adjustable.

8. The combination as defined in claim 1 wherein:
said latching means being continuously spring biased toward said unlatched position, with said latching means in said latched position a latching pawl connecting with said latching means to hold said latching means in said latched position.

* * * * *